US008430280B2

(12) United States Patent
Schumacher et al.

(10) Patent No.: US 8,430,280 B2
(45) Date of Patent: Apr. 30, 2013

(54) SUBMERGED NOZZLE

(75) Inventors: Edgar Schumacher, Munich (DE); Renata Franzky, Munich (DE); Sagadat Schumacher, Munich (DE); Alexander Kasymovich Farmanov, Bekabad (UZ); Viktor Nikolaevich Chloponin, Moscow (RU); Ivan Vasilevich Zinkovskij, Moscow (RU); Ewald Antonovich Schumacher, Munich (DE); Sagadat Schumacher, legal representative, Munich (DE)

(73) Assignee: Techcom GmbH, Munich (DE)

( * ) Notice: Subject to any disclaimer, the term of this patent is extended or adjusted under 35 U.S.C. 154(b) by 10 days.

(21) Appl. No.: 12/667,332

(22) PCT Filed: Jul. 3, 2008

(86) PCT No.: PCT/IB2008/001753

§ 371 (c)(1),
(2), (4) Date: Mar. 23, 2010

(87) PCT Pub. No.: WO2009/016442

PCT Pub. Date: Feb. 5, 2009

(65) Prior Publication Data

US 2010/0187266 A1 Jul. 29, 2010

(30) Foreign Application Priority Data

Jul. 4, 2007 (RU) ..... 2007125269

(51) Int. Cl.
*B22D 41/50* (2006.01)

(52) U.S. Cl.
USPC ..... 222/591; 164/437

(58) Field of Classification Search ..... 222/591, 222/600, 607, 594; 266/236; 164/437
See application file for complete search history.

(56) References Cited

U.S. PATENT DOCUMENTS

| | | | | | |
|---|---|---|---|---|---|
| 2,736,935 | A | * | 3/1956 | Shea | 251/319 |
| 5,046,647 | A | * | 9/1991 | Kawai et al. | 222/594 |
| 5,681,499 | A | * | 10/1997 | Benson et al. | 222/606 |
| 5,954,989 | A | * | 9/1999 | Brook et al. | 222/600 |
| 6,675,996 | B1 | * | 1/2004 | Miyamoto et al. | 222/594 |

FOREIGN PATENT DOCUMENTS

| | | | |
|---|---|---|---|
| FR | 2227728 | * | 11/1974 |
| RU | 2167031 | * | 5/2001 |
| RU | 2236326 | * | 9/2004 |

* cited by examiner

*Primary Examiner* — Scott Kastler
*Assistant Examiner* — Michael Aboagye
(74) *Attorney, Agent, or Firm* — Notaro, Michalos & Zaccaria P.C.

(57) ABSTRACT

A submerged nozzle has a lower part with a bottom and two outlet side channels above the bottom, and a skirt with a center fixed to the lower part of the nozzle above the outlet side channels. The skirt has two parallel flat surfaces each having side edges that are smoothly connected to each other by two respective cylindrical surfaces, the two outlet side channels being identical and lying along a common longitudinal axis making an acute angle with the parallel flat surfaces. A portion of the skirt is spaced apart from the nozzle to allow hot metal to flow in the space between the nozzle and the skirt.

5 Claims, 1 Drawing Sheet

SUBMERGED NOZZLE

BACKGROUND OF THE INVENTION (1) Field of the Invention

The invention relates to ferrous metallurgy, in particular, to slab production by continuous casting in ferrous metallurgy.

During continuous steel casting an important technical task is destruction of consistency in dendrite formation at the first stage of steel crystallization in a mold.

(2) Description of Related Art

Use of a submerged nozzle for steel transfer from an intermediate ladle into the mold is known from description of a continuous casting method (refer to, for example, patent RF No 2165825, B 22 D 41/50, published 27 Apr. 2001, Mb 12).

The main disadvantage of the known submerged nozzle lies in the fact that the technique implemented in this case in a greater or lesser degree relates to steel casting into blanks with a low ratio B:h, where h—height of blank section; B—width of blank section. Thus, the use of the known submerged nozzle is not efficient at continuous steel casting resulting in slab production if B>>h.

Description of a submerged nozzle for steel continuous casting (refer to, for example, patent RF Mb 2148469, B 22 D 11/10, published 10 May 2000, j\b 13), in which metal flow direction is changed as it leaves a closed-bottom submerged nozzle and enters a mold and metal is directed to corners of a square mold through side outlet channels, is known. The following disadvantages are inherent to the known submerged nozzle: metal jet leaving the side channels of the nozzle hits the mold walls directly that is not desirable as the possibility of destruction of a forming sinterskin of the crystallized metal increases, a risk of accidental metal entry occurs; metal does not curl in the mold what excludes an active influence on dendrites formed during crystallization, reduces the quality of the blank; thus the submerged nozzle is intended to be used for square blank casting only.

A submerged nozzle comprising a bottom and outlet side channels, located fan-shaped in a circumferential direction with displacement and curvature of their longitudinal axes relatively to the nozzle longitudinal axes, in the lower part is known (refer to, for example, patent RF Ns 2167031, B 22 D 41/50, published 20 May 2001, Ns 14).

The disadvantages eliminating full-scale implementation of the tasks, which arise at continuous slab casting, are inherent to the known submerged nozzle. These disadvantages are as follows: nozzle design does not exclude a direct force contact of steel jets leaving the nozzle with the mold walls, what is extremely undesirable taking into account the conditions of metal crystallization; design of the outlet side channels in the nozzle excludes an intensive coverage of steel volume, located below the level of these channels, by rotation. Thus, coverage of the most part of the hot metal in the mold by rotation is difficult.

A submerged nozzle for continuous steel casting from an intermediate ladle into a mold comprising a bottom, side channels and a skirt fixed to the lower part of the nozzle above the outlet side channels, in the lower part is known (refer to, for example, patent RF JVe 2236326 with priority dated 4 Nov. 2002).

Based on a set of the essential features the specified submerged nozzle is the most similar to the proposed one, thus it is taken as a prior art.

The known submerged nozzle has an essential disadvantage being in the fact that it can not be used effectively at continuous slab casting if B>>h as in this case coverage of the bulk steel, contained in the mold, by rotation is eliminated.

The proposal of curling the steel supplied into the mold using two submerged nozzles with the skirts, curling the steel like engaged gears, examined in the patent under consideration is efficient at minor deviations of B/h (maximum 2.5 . . . 3) which are not characteristic to the main sizes of continuously-casted slabs if B/h has the value of 4.4 . . . 7.4 and greater.

BRIEF SUMMARY OF THE INVENTION

The proposed submerged nozzle is free from the specified disadvantages of the known nozzle. Use of the proposed nozzle makes the provision for bulk steel curling and supply in a curled state into the mold volume providing production of the continuously-casted slabs in the whole range of the main sizes that is with ratio B/h>>3.

The technical result is achieved due to the fact that according to the proposal the skirt in the submerged nozzle comprising the bottom, side channels and the skirt fixed to the lower part of the nozzle above the outlet side channels, is formed by two parallel flat surfaces which are smoothly mated with the edges by means of cylindrical surfaces, besides the nozzle is located in the center of the skirt and has two opposite identical side channels with a common longitudinal axis making a sharp angle with the parallel flat surfaces of the skirt. Moreover the sharp angle is equal to 20 . . . 45°.

BRIEF DESCRIPTION OF THE DRAWINGS

The proposed submerged nozzle is illustrated by the drawings in FIGS. 1-4.

DETAILED DESCRIPTION OF THE INVENTION

Figure 1:
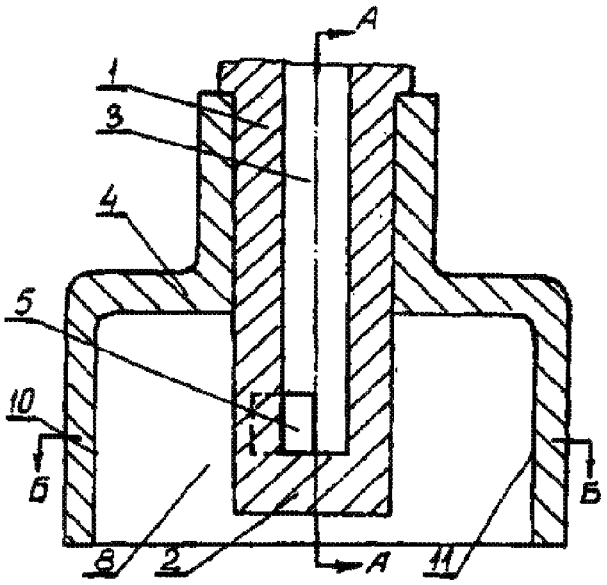
In FIG. 1 the submerged nozzle in a longitudinal section is shown.
Figure 2:
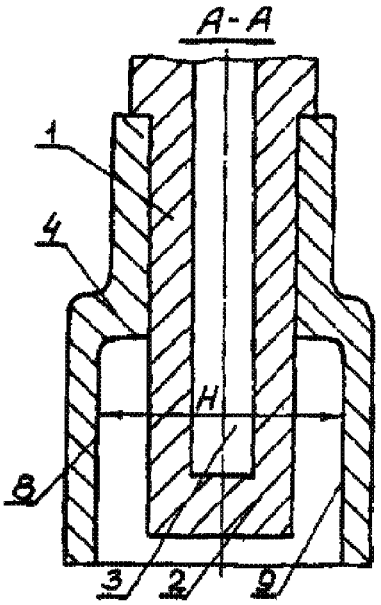
in FIG. 2 A-A Section of FIG. 1 is shown.
Figure 3:
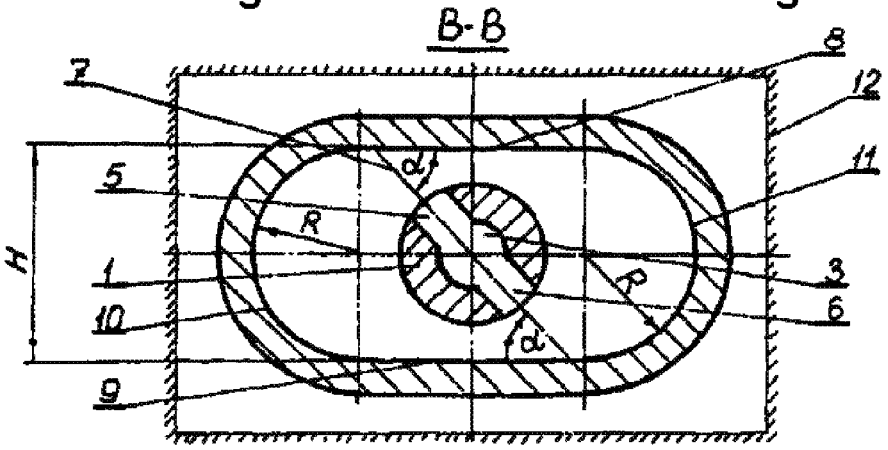
in FIG. 3—Cross Section Б - Б of the submerged nozzle with the skirt from FIG. 1 and its location relatively to the mold during operation.
Figure 4:
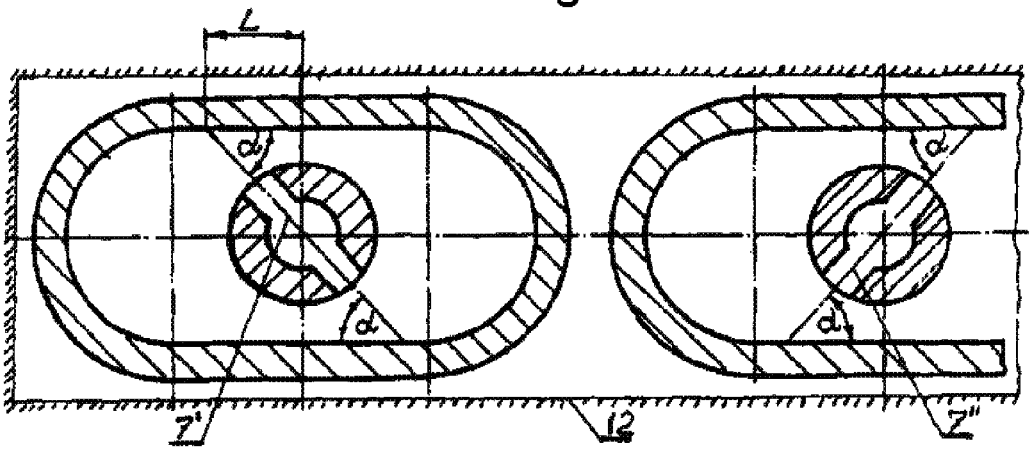
in FIG. 4—arrangement of the submerged nozzles if there are a few of them and their location relatively to the mold during operation.

Submerged nozzle 1 (FIGS. 1 and 2), nozzle bottom 2, opening 3 for hot metal flowing from the intermediate ladle into the mold, skirt 4 fixed to the lower part of the nozzle, two identical side channels 5 and 6 (FIG. 3) which are opposite and have common longitudinal axis 7. The skirt is made drawn along its cross section (FIG. 3) until two parallel flat surfaces 8 and 9, smoothly mated with the edges by cylindrical surfaces 10 and 11, and radius R equal to a half of distance H between parallel flat surfaces 8 and 9 (FIG. 3) are formed. Longitudinal axis 7 makes the sharp angle a (FIG. 3) with surfaces 8 and 9. The value of angle a is taken as equal to 20 . . . 45°. The submerged nozzle (nozzles) is installed in slab mold 12 (FIGS. 3 and 4).

If a<20°, an increase of distance L from metal outlet of the side channel to the parallel surface (FIG. 4) causes a notable rise in loss of the hot metal flow momentum, going out of the side channels, resulting in decrease of torque at flow meeting the flat surface of the skirt that is rotation of the metal flowing out of the skirt into the common mold volume decreases.

If a>45° a component of the hot metal flow, going out of the side channels, along flat surfaces 8 and 9 of the skirt decreases notably, thus the torque of metal rotation in the skirt and thereafter in the common mold volume decreases.

Thus, in both cases (if a<20° and a>45°) the efficiency of the skirt use for curling the metal supplied in curled state into the mold volume decreases.

When applying the proposed submerged nozzle in the processes of wide slab casting (with a high ratio B/h) a few submerged nozzle are used, besides longitudinal axes 7 of the side channels of different nozzles are located towards each other: 7' and 7" (FIG. 4). So, during continuous steel casting the technique of steel flow curling like engaged gears known from patent RF 2236226 is implemented.

Finally application of the proposed submerged nozzle allows making maximum use of the effect of metal flow curling in the restricted mold volume (under the skirt) and metal supply in curled state into the mold volume at continuous slab casting. The information mentioned above, in its turn, contributes to creation of the environment for thorough steel mixing in the mold volume with minimum impact on metal meniscus, almost completely eliminates the intensive steel flows in longitudinal direction (in height) of the crystallizing metal, excludes the metal jet hitting the crystallizing sinterskin of the metal. A set of the specified effects from using the proposed submerged nozzle creates the necessary and sufficient conditions for production of quality continuously-casted slabs.

The invention claimed is:

1. A submerged nozzle comprising: a lower part having a bottom with two outlet side channels above the bottom, and a skirt with a center fixed to the lower part of the nozzle above the outlet side channels, the skirt comprising two parallel flat surfaces each having side edges that are smoothly connected to each other by two respective cylindrical surfaces, the two outlet side channels being identical to each other and lying along a common longitudinal axis making an acute angle with the parallel flat surfaces of the skirt and wherein a portion of the skirt is spaced apart from the nozzle to allow hot metal to flow in the space between the nozzle and the skirt.

2. The submerged nozzle according to claim 1, wherein the acute angle is equal to 20 to 45°.

3. The submerged nozzle according to claim 1, wherein the two outlet side channels are parallel to the bottom.

4. The submerged nozzle according to claim 1, wherein the nozzle includes an opening having smooth sides for receiving hot metal.

5. The submerged nozzle according to claim 1, wherein the skirt is configured to be submerged in hot metal.

* * * * *